US009919187B2

(12) United States Patent
Barone

(10) Patent No.: US 9,919,187 B2
(45) Date of Patent: Mar. 20, 2018

(54) SWIMMING GOGGLES AND METHOD FOR DESIGNING THE SAME

(71) Applicant: MARES S.P.A., Rapallo (GE) (IT)

(72) Inventor: Aristide Barone, Rapallo (IT)

( * ) Notice: Subject to any disclaimer, the term of this patent is extended or adjusted under 35 U.S.C. 154(b) by 0 days.

(21) Appl. No.: 15/511,110

(22) PCT Filed: Sep. 16, 2015

(86) PCT No.: PCT/IB2015/057125

§ 371 (c)(1),
(2) Date: Mar. 14, 2017

(87) PCT Pub. No.: WO2016/042495

PCT Pub. Date: Mar. 24, 2016

(65) Prior Publication Data

US 2017/0239528 A1 Aug. 24, 2017

(30) Foreign Application Priority Data

Sep. 17, 2014 (IT) ..... GE2014A0093

(51) Int. Cl.
*A61F 9/02* (2006.01)
*A63B 33/00* (2006.01)

(52) U.S. Cl.
CPC ..... *A63B 33/002* (2013.01); *A63B 2033/006* (2013.01)

(58) Field of Classification Search
CPC ..... A63B 33/002; A61F 9/025; A61F 9/02; G02C 5/0455
See application file for complete search history.

(56) References Cited

U.S. PATENT DOCUMENTS 4,286,340 A * 9/1981 Lathrop ..... A63B 33/002 2/430
4,353,134 A * 10/1982 Macnabb ..... A63B 33/002 2/428
4,405,212 A 9/1983 Cooper
4,755,040 A * 7/1988 Haslbeck ..... A63B 33/002 2/428
6,079,054 A * 6/2000 Chou ..... A63B 33/002 2/428
7,779,488 B2 * 8/2010 Fukasawa ..... A63B 33/002 2/428

(Continued)

FOREIGN PATENT DOCUMENTS

CN 2451155 10/2001
CN 201327551 10/2009

(Continued)

*Primary Examiner* — Tejash Patel
(74) *Attorney, Agent, or Firm* — Themis Law

(57) ABSTRACT

Swimming goggles include two eyepieces with a substantially cup-like shape, a bridge element connecting the two eyepieces at the nose, a strap wrap the head, couple the outer ends of each eyepiece and keep the goggles in place when in use, wherein each of the two eyepieces includes at least one polygonal plan shaped flat front lens or wall and a shell wall composed of a set of polygonal plan shaped flat lenses joined to each other, along adjacent contact edges, and with the peripheral edge of the at least one flat front lens or wall to delimit a reduced volume inner chamber, which is completely open towards the rear part of the eyepiece, that is, towards the eye.

22 Claims, 6 Drawing Sheets

(56) References Cited

U.S. PATENT DOCUMENTS

Figure 1:
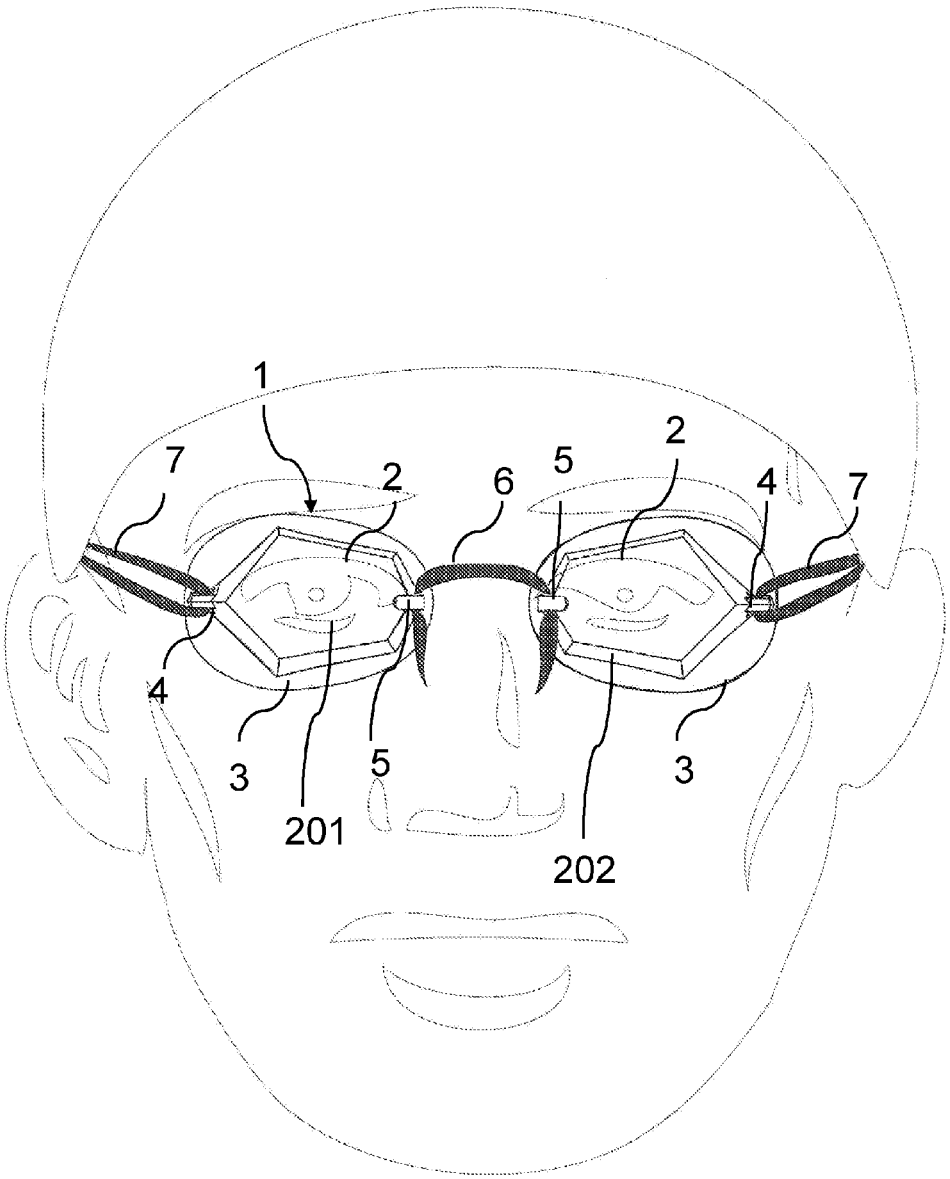

| | | | | |
|---|---|---|---|---|
| 2004/0158916 | A1* | 8/2004 | Sung | A63B 33/002 2/426 |
| 2010/0033671 | A1* | 2/2010 | Campo | A63B 33/002 351/43 |
| 2013/0019386 | A1* | 1/2013 | Hahn | A63B 33/002 2/431 |
| 2013/0187786 | A1* | 7/2013 | Dadlani Mahtani | A61F 9/029 340/691.8 |
| 2014/0041106 | A1* | 2/2014 | Shau | A63B 33/00 2/438 |

FOREIGN PATENT DOCUMENTS

| | | |
|---|---|---|
| EP | 0255262 | 2/1988 |
| TW | M469934 | 1/2014 |

* cited by examiner

Swimmer view field

SWIMMING GOGGLES AND METHOD FOR DESIGNING THE SAME

The present invention relates to swimming goggles intended to be worn by a user when swimming.

Swimming goggles typically comprise two eyepieces, with a substantially cup-like shape, a bridge element joining said two eyepieces at the nose, a strap wrapping the head and intended to couple the outer ends of each eyepiece and to keep the goggles in place when in use.

Swimming goggles used in training and in competitions, the so called "Swedish goggles", generally have a pair of eyepieces made of transparent plastic material with such a size to surround the eye and to allow vision both underwater and above water.

Other types of swimming goggles have lenses fitted in a support frame, which, unlike diving masks, lets the user nose free.

In some goggles the rear part of each eyepiece, faced towards the user face, may be provided with a seal made of soft, yielding material that prevents water from entering between the eyepiece and the face part on which said eyepiece is applied when goggles are worn.

It is known that under-water the main problem is that a non-flat lens leads to refraction problems, since water and air have very different refractive indexes, negatively affecting the vision.

For example in diving masks in order to overcome such problem, a flat lens or a pair of flat lenses are provided which are kept co-planar in front of the diver's eyes by means of a rigid frame structure: therefore vision is free from defects but the visual field is strongly limited, it is practically null at the sides. Moreover masks or goggles made according to this technical solution have a high hydrodynamic encumbrance that makes them not useful for being used in competitive swimming.

Other masks or goggles have completely curved lenses but by this embodiment the visual field free from defects is considerably reduced and the curved regions create out of focus images.

There are also masks having a flat front lens and two flat or curved lateral lenses. For example generally swimming goggles have a pair of eyepieces each one composed of a front transparent lens parallel to the face projecting backwardly, connecting, with a curved lateral wall or lens, transparent as well, that delimits by said front surface an open chamber towards the rear part of the eyepiece, that is towards the eye.

This arrangement allows the visual field to be extended also laterally but it is not free from defects: the image is "broken" due to blind fields at the connections between the front lenses and the lateral lenses and the vision through the curved lenses deforms and puts images out of focus.

The known swimming goggles also have further drawbacks.

In some cases the lenses of the eyepieces are too much spaced ahead of the eyes, and this may create visual problems, particularly as regards the near vision.

Moreover the presence of too much bulky eyepieces, that protrude both forwardly and laterally of the swimmer face, makes goggles little hydrodynamic and unstable, particularly in case of impact with the water during dives, in fast swimming or in stream with rough water, conditions that tend to displace the goggles from their correct position on the face. In some cases goggles have also lenses made of glass and therefore they are heavy, dangerous and uncomfortable to be worn, particularly during the long training sessions or in competitions.

Often in the goggles the region of contact between the eyepieces and the swimmer face at the eye sockets is considerably reduced and it does not allow watertightness to be kept under all swimming conditions or it does not allow the position of the goggles on the face to be firmly kept, with consequent defects as regards vision.

Moreover in order to guarantee the watertightness on the face surface about the eyes, the eyepieces have to be orientable and this usually leads to distortions and imperfections in the visual field. At the same time, in use, in order to have a good vision, the swimmer often has the tendency to displace or rotate the eyepieces, but this leads to watertightness problems between the contact elements at the eye sockets.

The forward, inner lateral, outer lateral, upper and lower visual field of a swimmer is determined by needs deriving from what the swimmer has to see well in order to orientate himself/herself when swimming. These visual fields are not the same for all the swimming styles. Therefore in order to optimize the vision with the known swimming goggles, the swimmers provide to modify the position of the goggles such to cause the transparent surfaces to be oriented that generate visual fields corresponding to the needs dictated by the swimming activity performed, thus resulting in the above watertightness problems.

The aim of the present invention is to overcome the visual problems just described above by providing swimming goggles guaranteeing, when in use, a panoramic vision substantially of or almost of 180°, without obstacles and optical disturbances.

A further aim of the present invention is to provide goggles that are light, comfortable, easy to be worn, with an easy adjustment of the strap, guaranteeing the watertightness on the swimmer face and that has an extremely reduced hydrodynamic encumbrance, with a consequent enhanced stability on the swimmer face both when diving and in fast swimming or in stream, rough water.

From the above it is clear that the technical effects pursued by the present invention are needs conflicting with each other and that the optimization of a characteristic can negatively affect one of the other characteristics or other pursued technical effects.

Therefore the invention aims at providing swimming goggles being a compromise between the conflicting needs mentioned above and that allow all the problems of the known goggles to be solved at a greatest extent, without resulting in declines of some performances to the detriment of the maximization of other ones.

According to the invention these aims are achieved by swimming goggles comprising:

two eyepieces, with a substantially cup-like shape; a bridge element connecting said two eyepieces at the region associated to the nose;

a strap for wrapping the head and intended to couple the outer ends of each eyepiece and to keep the goggles in place when in use, and wherein each one of the two eyepieces comprises at least one polygonal plan shaped flat front lens or wall and at which perimetral edges a shell wall is connected which is composed of a set of flat, transparent lenses, with a substantially polygonal plant shape too, which are joined with each other, along adjacent contact edges, and with the peripheral edge of the at least one flat front lens such to delimit an inner chamber which is completely open towards the side of the eyepiece facing the eye.

In one embodiment said shell wall is substantially diverging and the eyepiece has a shape like a truncated pyramid with an irregular polygonal base, preferably hexagonal one.

On the side of the eyepieces facing the eye region, the edges of said shell wall are shaped correspondingly to a curved section plane of said pyramidal shape, the curve arrangement of said plane being anatomically fitted on or corresponding to the shape of the region of contact of the eyepiece with the face region surrounding the corresponding eye. Along such edge there is advantageously provided a tight seal.

In a preferred embodiment each one of the two eyepieces comprises only one polygonal plan shaped flat front lens.

In the present description and in the claims the term "lens or wall" means a transparent wall or more generally a transparent diaphragm separating, with the goggles in use, water from air in the inner chamber of the eyepiece rested on the face surface surrounding the eyes.

Moreover the terms "vertical", "horizontal", "upper", "lower", "outer", "inner" have to be considered to be referred to the worn condition of the goggles on the face of an upright user.

The term "flat" lens or wall comprises also the term "planar".

According to a preferred embodiment of the present invention the eyepieces of the goggles are composed of a rigid, transparent and plastic material, possibly colored and possibly treated to be anti-fogging and/or anti-scratching, and/or photoabsorbing and/or mirror-finished: this allows goggles to be provided that are light, stable on the user face and aesthetically pleasant.

Obviously it is possible to use any other transparent material, such as glass, that enables the vision and/or to use prescription lenses in particular with reference to the front lens or wall.

Each eyepiece is composed of flat lenses such to avoid out of focus and deformed images.

According to the present invention the polygonal plan shaped flat front lens or wall is inclined forward such that its lower end is displaced in a front direction, that is forwardly, with respect to the upper end, with reference to goggles worn by a user in the upright position.

As an alternative, the front wall or lens can be inclined forward such to displace its upper end forward with respect to the lower one, with reference to goggles worn by a user in the upright position. Advantageously the shape of the goggles can be substantially symmetrical with respect to a transverse plane containing the interocular axis, therefore it is possible to pass from the configuration of the front lens with forward inclination of the lower side with respect to the upper side and to that of the upper side with respect to the lower side by simply mounting the goggles rotated by 180° with respect to the axis coinciding with the sagittal axis in the worn condition.

The two configurations of inclination of the front wall allow the usable visual field obtainable with the goggles to be oriented in the forward visual direction more upwardly or more downwardly, that is towards the feet.

This is important for the several swimming styles that require seeing more upwardly or more downwardly, both for controlling the movements, for controlling the direction, and in the competitive field for controlling the competitor swimmers.

With reference to goggles worn by a user in the upright position, the shell wall of each eyepiece comprises:

at least one flat upper lens with a polygonal plan shape, preferably, at least on three sides, irregular trapezoidal one, allowing upward vision, at least one flat lower lens with a polygonal plan shape, preferably, at least on three sides, irregular trapezoidal one, allowing downward vision, at least one inner flat lateral lens with a polygonal plan shape, preferably, at least on three sides, irregular trapezoidal one, allowing inward lateral vision (that is in the direction of the nose), at least one outer flat lateral lens with a polygonal plan shape, preferably, at least on three sides, irregular trapezoidal one, allowing outward lateral vision (that is in the direction of the swimmer temple).

Preferably the area of said at least one polygonal plan shaped flat lower lens is greater than the area of said at least one polygonal plan shaped flat upper lens.

Moreover it is possible to provide the polygonal plan shaped flat upper lens and/or the polygonal plan shaped flat lower lens to be inclined towards the inner angle of the eye such to promote the vision in the lateral-upward and lateral-downward direction. According to the present invention the shell wall comprises at least one lens, among those forming the shell wall, joined inclined with said polygonal plan shaped flat front lens or wall, which lens forms, with the inner surface of said wall, an angle greater than 90°. As an alternative or in combination it is possible to provide at least one lens, among those forming the shell wall, joined inclined with said polygonal plan shaped flat front lens or wall and forming with the inner surface of said wall (201) an angle smaller than 90°.

According to one embodiment of the present invention the polygonal plan shaped flat front lens or wall has at least 5, preferably 6, vertices with two pairs of side edges and a lower and/or upper edge, two of said vertices being substantially coincident with the outer angle and the inner angle of the eye: as a consequence the shell wall of each eyepiece comprises two pairs of polygonal plan shaped flat lenses joined with the peripheral edge of said polygonal plan shaped flat front lens or wall and joined with each other, along adjacent contact edges, such to form a V, in section, with the vertex at the outer angle and inner angle of the eye respectively.

Preferably the pair of lenses with the vertex at the outer angle of the eye has an area greater than the pair of lenses with the vertex at the inner angle of the eye.

The mutual inclination of the lenses, both one with respect to the other and with respect to the eye, and their reduced number in favor of the increase in their surface allows the number of connections and therefore the image distortion regions to be reduced and it allows the user practically to have a panoramic and continuous up-down and right-left vision.

Moreover the fact of increasing the areas of the lenses in the regions of highest visual importance (frontal, downward and outward lateral regions) combined with the fact of reducing the areas of the lenses for the vision in visual sub-fields with less importance for the swimmer (for example upward vision, which however is already physically limited by the eyebrow arch, and inward vision, towards the nose) allows the visual field to be optimally wide and at the same time to have optimal hydrodynamic goggles.

The moderate projection of the goggles of the present invention with respect to the face helps in considerably reducing the hydrodynamic drag.

The size and the arrangement of the lenses in the eyepiece of the goggles of the present invention combined also with the provision of a peripheral adhesion lip, allows the position of the lenses to be always optimal with respect to the direction the swimmer is looking.

Coupling seats provided on each eyepiece, of a bridge element and a strap, help in keeping the lenses in the correct position with respect to the eye, in order to guarantee the maximum vision, said seats being provided on a plane parallel to a transverse axis of the skull.

In order to facilitate the adhesion of the goggles on the face the peripheral edge of the shell wall faced towards the face radially projects by a peripheral adhesion lip. Said lip has such a size and shape to match each face, in the contact region about each eye.

The substantially elliptical shape, tapered towards the nose and the arcuate shape of the lip allow the goggles to remain firmly on the face, also in case of a strong impact with water or in case of whirling motions and/or stream in water.

The invention relates also to a method for designing swimming goggles, particularly eyepieces of swimming goggles, which method comprises the following steps:

determining the essential visual fields for carrying out swimming activity according to a predetermined style, with reference to the position of the swimmer in the space and to the vision in the front direction, inner lateral and outer lateral direction, and in the upward and downward direction;

defining planes delimiting said visual fields with each other;

generating a set of planar lenses having a predetermined orientation with respect to the visual axis relative to a visual field in a corresponding visual direction;

defining the connecting vertices between adjacent flat lenses at the straight lines of incidence of the planes delimiting said visual fields with the planes defining said flat lenses;

defining an ideal curved surface corresponding to the anatomical shape of the region around the eye, of contact of the eyepiece with said region and shaping the edge of the corresponding flat lens in a manner corresponding to said curve coinciding with said planar lens, that is with the intersection of said curved surface with said flat lens.

Figure 2A:
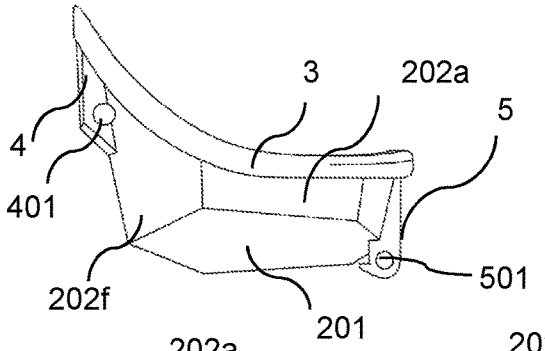
Figure 2B:
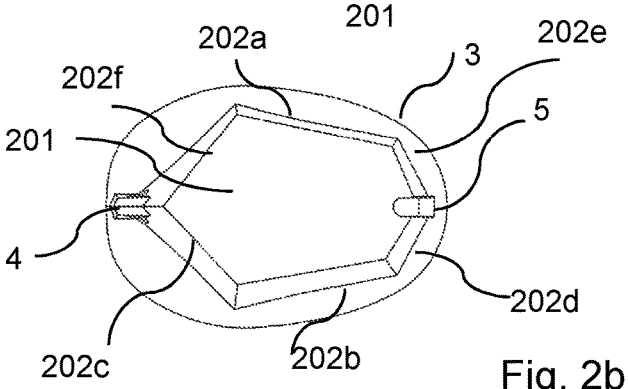
Figure 2C:
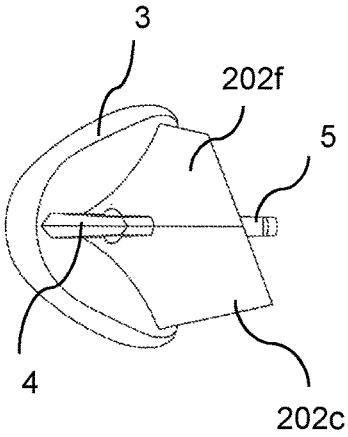
Figure 2D:
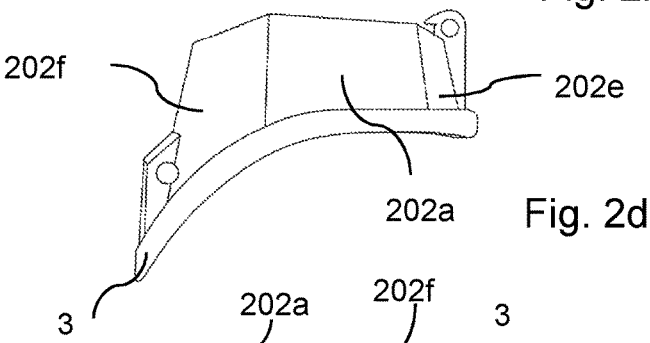
Figure 2E:
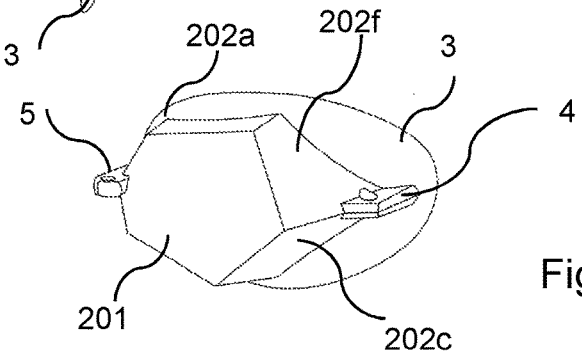
Figure 3A:
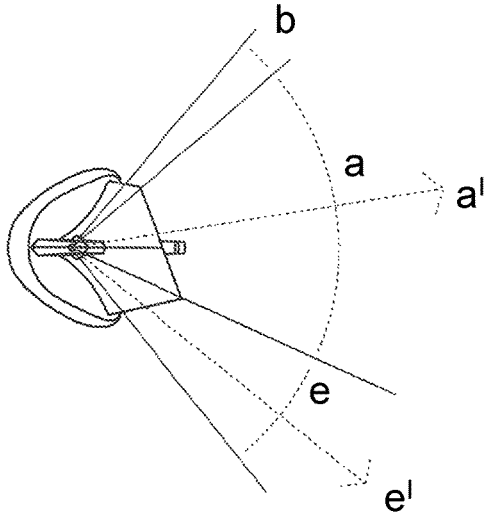
Figure 3B:
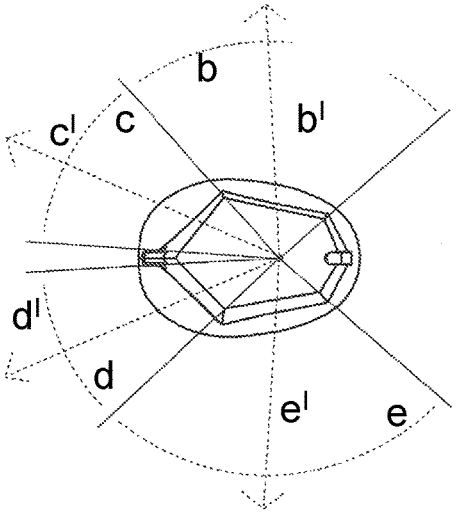
Figure 3C:
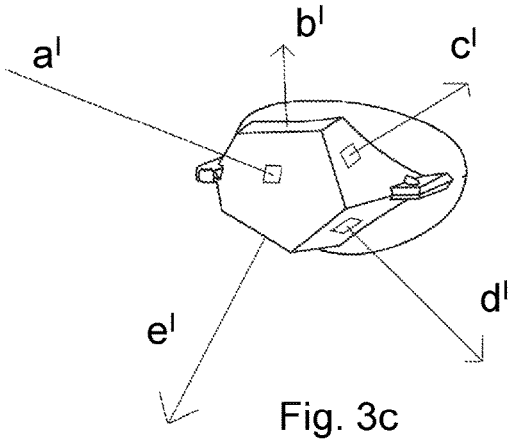
Figure 4:
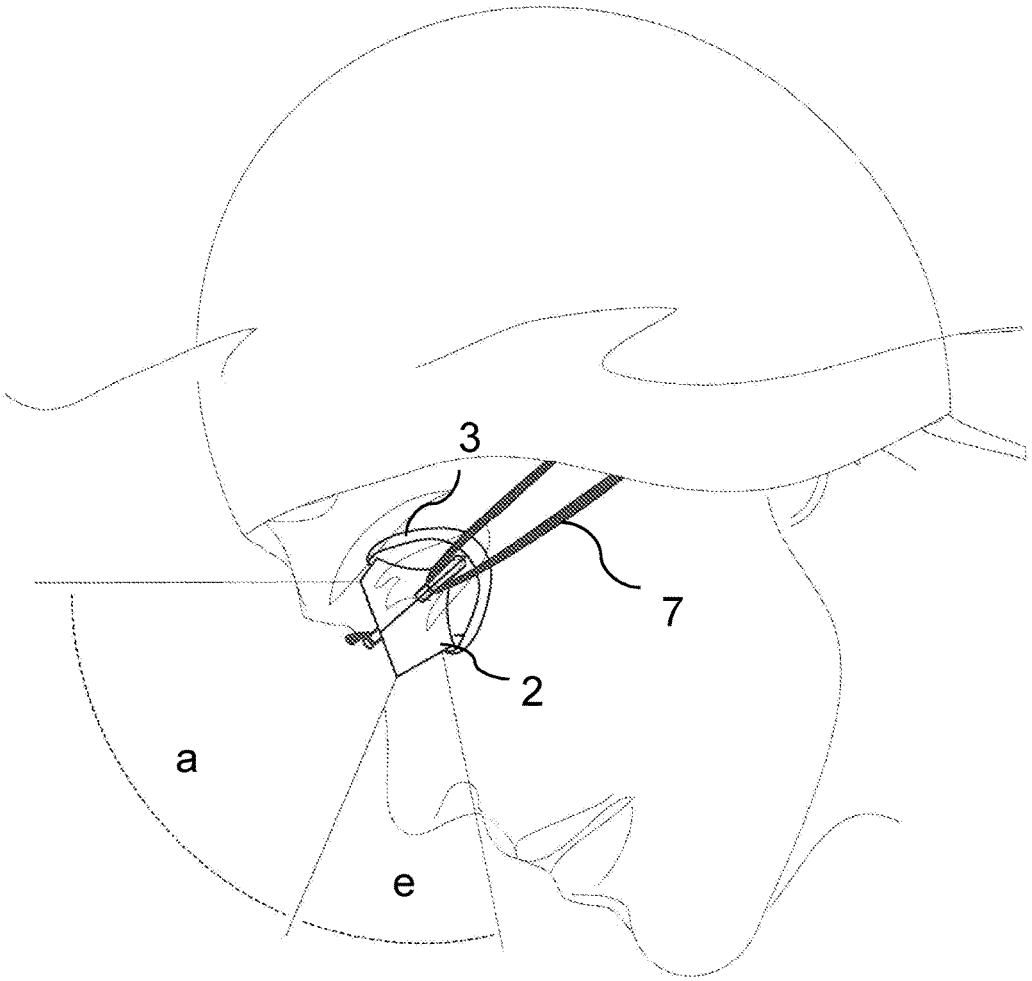
Figure 5A:
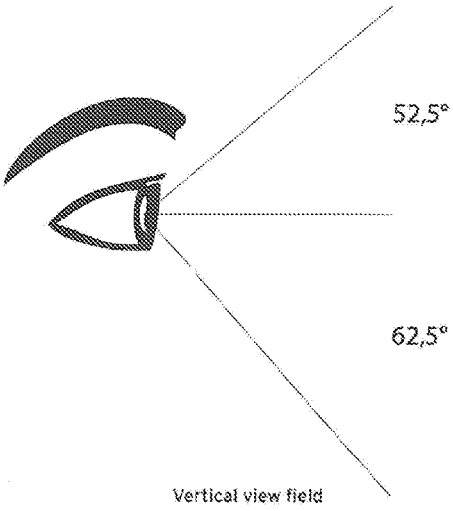
Figure 5B:
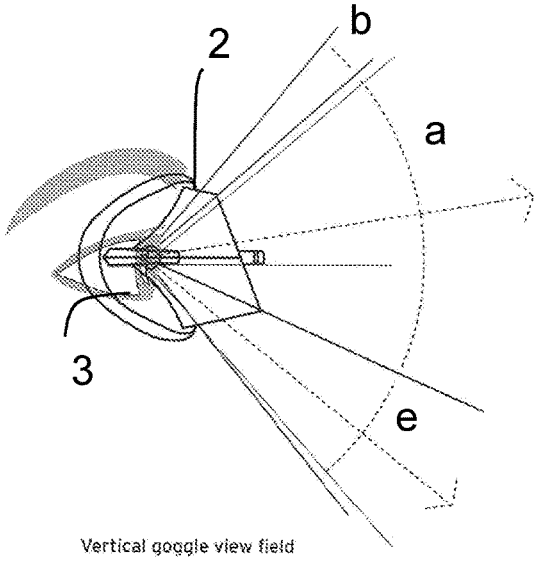
Figure 5C:
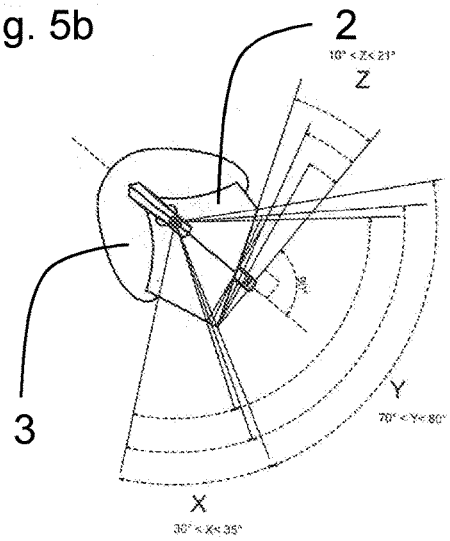

These and other characteristics and advantages of the present invention will be more clear from the following description of some embodiments shown in the annexed drawings wherein:

FIG. 1 is the goggles according to the present invention worn by the swimmer, FIG. 2*a* is a perspective view of the eyepiece of the present invention, FIG. 2*b* is a plan view of the eyepiece on the front wall according to an orientation substantially parallel to the forward visual direction;

FIG. 2*c* is a side view of the eyepiece of the present invention;

FIG. 2*d* is a top view of the eyepiece of the present invention;

FIG. 2*e* is a perspective side view of the eyepiece of the present invention;

FIG. 3*a* is the wideness of the visual field of the user through the eyepiece of the present invention;

FIG. 3*b* is the portions of the visual field corresponding to each lens of the eyepiece and the respective central visual axes;

FIG. 3*c* is a perspective side view of the eyepiece of the present invention with the central visual axis of each lens;

FIG. 4 is the goggles of the present invention worn by the swimmer underwater and the wideness of the visual field;

FIG. 5*a* is the wideness of the visual field of a man in the upright position;

FIG. 5*b* is the wideness of the visual field of a man in the upright position through the goggles of the present invention;

FIG. 5*c* is the wideness of the visual field of a man in the horizontal position underwater through the goggles of the present invention.

Figure 6:
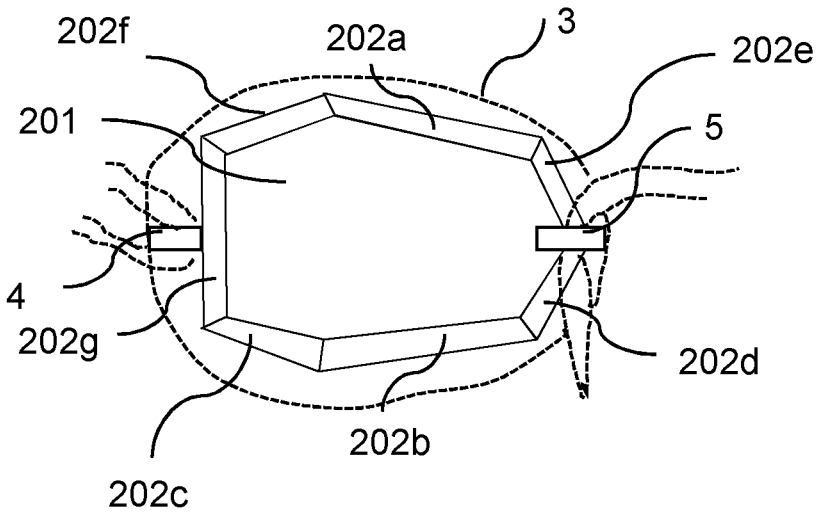

FIG. 6 is a further variant wherein the eyepieces have a transparent front wall or front lens with a polygonal shape with seven corners that is heptagonal.

The swimming goggles shown in the figures are suitable for being used in sports or activities that need to protect the eye from contacting water. Particularly they are suitable for swimming and are usable both when training and in competition.

Such as shown in FIG. 1 the swimming goggles 1 comprise two eyepieces 2, with a substantially cup-like shape, a bridge element 6 connecting said two eyepieces 2 at the nose, a strap 7 for wrapping the head and intended to couple the outer ends of each eyepiece 2 and to keep the goggles 1 in place when in use.

Each eyepiece 2 is made as one piece made of a rigid and transparent plastic material: this allows to provide light goggles and easy to be manufactured since they are made by a single injection molding operation.

It is possible to use acrylic plastic material or a carbonate material such as polycarbonate, polyamide, polypropylene or the like; the material can be colored, mirror-finished, with anti-scratching and/or anti-fogging properties.

According to the present invention each one of the two eyepieces 2 comprises at least one polygonal plan shaped flat front wall or lens 201 and a shell wall 202 composed of a set of polygonal plan shaped flat lenses, connected with each other, along adjacent contact edges, and with the peripheral edge of the at least one front flat wall or lens 201 such to delimit a reduced volume inner chamber which is completely open towards the rear part of the eyepiece 2, that is towards the eye.

In a preferred embodiment each one of the two eyepieces 2 comprises only one polygonal plan shaped flat front wall or lens 201.

Said shell wall 202, as it is clear from FIG. 2*a*, has a greater height on the outer side (namely the side adjacent to the temple with the goggles in the worn condition) and a smaller height on the inner side (adjacent to the nose).

Each substantially cup-like shaped eyepiece 2 may have a cross-section perpendicular to the median axis of the polygonal shaped cup inscribable in an ellipse, with the longer axis substantially parallel to the transverse axis of the skull, which ellipse gets narrower towards the inner angle of the eye. Inner angle of the eye in the present description and claims means the angle at the lacrimal duct, while outer angle of the eye means the end of the eye opposite to the lacrimal duct.

A peripheral adhesion lip 3 radially extending from the peripheral edge of the shell wall 202 is shaped such to allow each eyepiece 2 to tightly rest on the face of the user around the eyes.

Said peripheral adhesion lip 3 allows each eyepiece 2 to tightly bear on the skin at the left and right eye socket, due to the fastening exerted by the length-adjustable and/or elastic strap 7 secured at the two outer sides of the shell wall 202.

As it is clear from FIG. 2*b* said peripheral adhesion lip 3 forms an outer peripheral surface with an elliptic shape substantially complementary to the shape of the face at the eye socket, which surface surrounds the pair composed of the polygonal plan shaped flat front wall or lens 201 and the shell wall 202 of the eyepiece 2.

As it is clear from FIG. 2*e* said peripheral adhesion lip 3 has a concave configuration with an arcuate cross-section such to allow each eyepiece 2 to tightly rest on the user face at the eyes.

In order to improve the seal on the user face the peripheral adhesion lip 3 particularly the surface of the lip 3 faced towards the user face or, in the embodiments not providing said lip 3, the peripheral edge of the shell wall 202 may be provided with a soft watertight element: such element is intended to be applied on the user face and to accomplish the watertightness of each eyepiece 2, preventing water from entering the inner chamber of said eyepiece 2 when goggles 1 are worn.

Said soft watertight element can be composed of an elastomeric foam coating covering the peripheral edge of the shell wall 202 or the surface of the peripheral adhesion lip 3 in contact with the face or of a gasket made of rubber, silicone or another elastomer fastened, by chemical/physical means or joined to said edge or lip 3.

The dimensions of each eyepiece 2 are such to allow the peripheral adhesion lip 3 to exert a pressure that is uniform and properly distributed along all the face portion about each eye: this allows an optimal watertightness between the goggles 1 and the user face to be obtained preventing water from entering and while guaranteeing the goggles 1 to be optimally hydrodynamic.

According to the present invention, as it is clear from FIG. 2*c*, each eyepiece 2 comprises at least one lens, which is the shell wall 202, joined inclined to said polygonal plan shaped flat front wall or lens 201, forming, with the inner surface of said front wall 201, an angle greater than 90° and/or it comprises at least one lens, which is the shell wall 202, joined inclined to said polygonal plan shaped flat front wall or lens 201 and forming with the inner surface of said front wall 201 an angle smaller than 90°.

Each eyepiece 2 is composed only of flat lenses. However the number of flat lenses is reduced, in favor of the increase in the surface thereof such to provide the greatest continuous vision and the smallest amount of connections between the lenses, reducing the visual distortions due to the passage from one to another flat lens.

Particularly the number of sides of the polygonal plan shaped flat front wall or lens 201 and therefore the number of polygonal plan shaped flat lenses of the shell wall 202 is kept reduced such to maximize the surface of the lenses and to maximize the continuity of the overall visual field and at the same time such to minimize the number of connections between the lenses and consequently to minimize the distortions of the overall visual field.

With reference to goggles worn by a user in the upright position, the shell wall 202 of each eyepiece 2 comprises at least one polygonal plan shaped upper flat lens 202*a* in order to allow the upward vision, at least one polygonal plan shaped lower flat lens 202*b* in order to allow the downward vision, at least one polygonal plan shaped outer lateral flat lens 202*c* and at least one polygonal plan shaped inner lateral flat lens 202*d* in order to allow the lateral vision.

Considering that the upward vision is hindered by eyebrow arches, it is possible to provide the area of said at least one polygonal plan shaped lower flat lens 202*b* to be wider than the area of said at least one polygonal plan shaped upper flat lens 202*a*, since the downward vision is particularly important for the swimmer since it allows the shape or the images on the bottom to be followed when swimming with the face underwater, such as the line of swimming pools.

It is possible to provide said at least one polygonal plan shaped flat upper lens 202*a* and/or said at least one polygonal plan shaped flat lower lens 202*b* to be inclined towards the inner angle of the eye such to promote the vision in the lateral-upward and lateral-downward direction.

In order to promote the lateral vision, the polygonal plan shaped flat front wall or lens 201 has at least 5 vertices, with two pairs of sides edges and a lower and/or upper edge, two of said vertices being substantially coincident with the outer angle and the inner angle of the eye: consequently the shell wall 202 of each eyepiece 2 comprises two pairs of polygonal plan shaped flat lenses 202*c*, 202*f*, and 202*e*, 202*d* joined with the peripheral edge of said polygonal plan shaped flat front wall or lens 201 and joined with each other, along adjacent contact edges, such to form, in section, a V, with a vertex at the outer angle and inner angle of the eye respectively. As it is clear from FIGS. 2*e* and 2*f* the area of each one of the polygonal plan shaped flat lenses 202*c*, 202*f* of the shell wall 202 joined with each other, along adjacent contact edges, such to form a V, in section, with the vertex at the outer angle of the eye is greater than the area of each one of the polygonal plan shaped flat lenses 202*e*, 202*d* of the shell wall 202 joined with each other, along adjacent contact edges, such to form a V, in section, with the vertex at the inner angle of the eye such to promote the vision in the lateral-outward direction, minimizing distortions.

Such as shown in FIGS. 3*a*-3*c* and 4 the size of the surface of the lenses 201, 202*a*, 202*b*, 202*c*, 202*d*, 202*e*, 202*f* that form each eyepiece 2 and the orientation of said lenses with respect to each other and to each eye, with the goggles 1 in the worn condition, is such to maximize the wideness and the sharpness of the visual field and such to divide the overall visual field into a plurality of visual sub-fields with a predetermined angle of view, each one corresponding to one of the lenses, said sub-fields corresponding to:

- a forward visual field portion (a);
- an upper visual field portion (b);
- an upward outer lateral visual field portion (c);
- a downward outer lateral visual field portion (d);
- a lower visual field portion (e);
- a upward inner lateral visual field portion (f);
- a downward inner lateral visual field portion (g), and each lens being placed with respect to the other ones such that, with the goggles 1 in the worn condition, each lens is perpendicular to the central visual axis of the visual sub-field $a^I$, $b^I$, $c^I$, $d^I$, $e^I$, $f^I$, $g^I$ corresponding thereto.

Particularly considering that for a swimmer the most important portions of the visual field are those that allow him/her to see frontally, the front bottom of the pool, the competitor swimmers and the swimmers behind him/her, according to the present invention the area of the lenses 201, 202*f*, 202*c*, 202*b* corresponding to:

- the forward visual field portion (a);
- the upward outer lateral visual field portion (c);
- the downward outer lateral visual field portion (d);
- the lower visual field portion (e), is greater than the area of the lenses 202*a*, 202*e*, 202*d* provided for the vision in the remaining portions of the visual field that is in the upper visual field portion (b), the upward inner lateral visual field portion (f) and the downward inner lateral visual field portion (g).

This embodiment allows also the hydrodynamic aspect of the goggles 1 to be promoted when swimming with the face underwater.

According to a non limitative embodiment shown in the figures the polygonal plan shaped flat front lens or wall 201 has a hexagonal shape and the shell wall 202 of each eyepiece 2 is composed of 6 polygonal plan shaped flat lenses, that is, considering the goggles 1 worn by an upright user, it is composed of a pair of lateral lenses 202*e* and 202*d* at the inner angle of the eye, a pair of lateral lenses 202*f* and 202*c* at the outer angle of the eye, a lower lens 202*b* and an upper lens 202*a* said lower lens 202*b* and said outer side lenses 202*c* and 202*f* having greater area than the remaining upper lens 202*a* and side lenses 202*e* and 202*d*.

As it is clear from FIGS. 3*b* and 4 this embodiment allows a wide visual field to be provided, both laterally and frontally, without distortions in the regions of greatest interest for the swimmer that is an optimal upward and downward forward vision, only limited by the eyebrow arch and by the cheeks, and an optimal lateral vision, particularly with reference to a user in the upright position, towards the outside, that is towards the side opposite to the nose.

According to the present invention the polygonal plan shaped flat front lens or wall 201 is inclined forward such to displace in a front direction, that is forwardly, its lower end with respect to the upper one, with reference to goggles worn by a user in the upright position.

Therefore in one embodiment such as shown in FIG. 2*c* the polygonal plan shaped flat lower lens 202*b* of the shell wall 202 forms an angle smaller than 90° with the polygonal plan shaped flat front lens or wall 201.

With reference to the goggles 1 worn by a user in the upright position, the polygonal plan shaped flat front lens or wall 201 has a forward inclination of the lower end with respect to the upper end, corresponding to an angle Z ranging from 10 to 21°. Particularly the polygonal plan shaped flat front lens or wall 201 can be inclined by 10°, 15° or 21°. Said polygonal plan shaped flat front lens or wall 201 therefore is rotated forward with respect to an axis intermediate to said front lens or wall 201 and substantially parallel to the transverse axis of the skull (that is to one of the main anatomical axes of the human body).

Such as shown in FIG. 5*b* the inclination of the polygonal plan shaped flat front lens or wall 201 allows the area of the polygonal plan shaped flat upper lens 202*a* of the shell wall 202 to be reduced, contributing to the hydrodynamic aspect of the goggles 1, however without reducing or distorting the upward vision since the latter is mainly guaranteed by the polygonal plan shaped inclined flat front lens or wall 201, and therefore it has no interruptions due to the presence of the connection with the polygonal plan shaped flat upper lens 202*a* which, since it has a reduced size, has the edge connecting with said polygonal plan shaped flat front lens or wall 201 substantially flush with the outer edge of the eyebrow arch.

Still with reference to FIG. 5*b* the downward vision, is guaranteed through the polygonal plan shape flat lower lens 202*b* and it is limited downwardly only by the cheeks.

Such as shown in FIG. 5*c* the inclination of the polygonal plan shaped flat front lens or wall 201 facilitates the forward vision when swimming with the face underwater.

According to one embodiment shown in FIG. 5*c* the polygonal plan shaped flat front lens or wall 201 is inclined forward and it has such dimensions to generate a forward visual field with an angle size Y ranging from 70° to 80°.

Moreover still as shown in FIG. 5*c* the lens 202*b* corresponding to the lower visual field portion (e) is inclined with respect to the polygonal plan shaped flat front lens or wall 201 and it has such dimensions to generate a visual field adjacent to the upper visual field having an angle size X ranging from 30° to 35°.

According to one embodiment the angle size Y is 78° and/or the angle size X is 32°.

Such as shown in FIGS. 5*a* and 5*b* the use of the goggles 1 of the present invention does not reduce the visual field of the user, particularly in the frontal direction, since said angle is substantially the same for a user with goggles or without them. Advantageously the visual field for each eye through the goggles 1 extends in a continuous manner, distortions due to the connections between the lenses being minimal, from the eyebrow arch to the cheeks with an overall angle equal to or more than 110°: the angle size of the forward visual field of a user wearing the goggles 1 can be compared with the angle size of the forward visual field of a user with no goggles 1, said extended field being without distortions or interruptions from the eyebrow arch to the cheeks of the user.

By means of the shape of the goggles 1 of the present invention, particularly due to the polygonal plan shaped flat front lens or wall 201, said goggles 1 can be used also for backstroke swimming: by wearing the goggles reversed, the direction of inclination of the polygonal plan shaped lens or wall 201 is reversed thus facilitating the vision of the lower body portion and of the swimmers that are behind.

In order to allow the goggles 1 to be worn by the user each eyepiece 2 is provided with coupling seats 4, 5 of a bridge element 6 and a strap 7, said seats being provided on a plane parallel to a transverse axis of the skull.

Said bridge element 6 and/or said strap 7 can be made of a rigid, semirigid, deformable, soft and/or elastic and/or length adjustable material.

Such as shown in the figures the shell wall 202 of each eyepiece 2 is provided, on the outer side, with a protuberance or extension 4 preferably made as one piece with said eyepiece 2 allowing one end of the strap 7 to be connected, and on the inner side with a protuberance or extension 5, it being made also as one piece, allowing one end of the bridge element 6 to be connected.

Said extensions or protuberances 4,5 can therefore be placed at the outer angle and at the inner angle of the user eye respectively.

Such as shown in the figures, according to one embodiment, said extensions or protuberances 4, 5 have at least one hole 401, 501 inside which the bridge element 6 and the strap 7 can pass which is made as a thread, ribbon, band or the like: in order to connect the two eyepieces 2 at the nose it is possible to provide to pass the bridge element 6 through the two holes 501, one on each eyepiece 2, and then to connect with each other the two ends of said element 6 for example by tying them, or it is possible to provide each end of the bridge element 6 to pass in the hole 501 of each extension or protuberance 5 provided on the eyepiece and then to tie it on itself such to prevent it from slipping out of the hole 501, such as shown in FIG. 1.

At the same manner it is possible to connect the strap 7 to the two eyepieces 2.

The assembly of said bridge element 6 and/or strap 7 on the eyepieces 2 allows to adjust both the length of the bridge element 6, therefore to approach or move away from each other the two eyepieces 2, fitting the goggles 1 to the shape of the user face and the length of the strap 7 that wraps the user head with the goggles 1 in the worn condition.

Obviously it is possible to provide said bridge element 6 and said strap 7 to be connected and/or fastened to said eyepieces 2 by any known means for example by overmolding soft plastic material on said eyepieces 2 and/or on the lip 3, or by using snap-on means such as buckles or the like.

Changes and/or modifications can be made to the swimming goggles 1 of the present invention without departing from the protective scope claimed below. With reference to FIG. 6 it shows a detail of the eyepiece 2 with heptagonal shape. The shown eyepiece is related to the right eye with reference to the user. The left eyepiece is symmetrically identical with reference to the sagittal plane.

In this case, the transparent front wall or front lens 201 that may exhibit a combination or sub-combination of the characteristics described for the other embodiments, at the outer corners of the eye, so called outer canthi, has an edge that is contained in a plane parallel to or substantially parallel to the sagittal plane. Particularly the transparent shell wall that is the set of transparent walls or flat lenses 202*a* to 202*g* are seven and the transparent wall or transparent lens 202*g* is oriented substantially vertically.

Like the other flat lenses 202*a* to 202*f* forming the shell transparent wall also such flat wall 202*g* can be inclined with its side facing the face displaced laterally outwardly with respect to the edge connecting to the front transparent wall or front lens 201 to the eye.

Such as shown and described, the eyepieces that is the front transparent wall or the front flat lens 201 thereof may have a polygonal shape with a different number of corners and therefore for example it can be pentagonal, hexagonal, heptagonal, etc. Therefore a corresponding number of flat transparent elements 202 are connected thereto forming the shell transparent wall of the eyepiece.

Other variants of the goggles that can be provided in any combination with the characteristics already described, advantageously are a strap composed of a tubular element made of compressed silicone.

The seals along the contact edges of the eyepiece at the peripheral lip 3 contacting the region around the eye of the face may be made by overmolding technique. The eyepieces may be made of polycarbonate and have a number of planar or flat surfaces corresponding to the selected polygonal shape of the front lens.

Also the nose pad may be composed of a tubular material element. Preferably this is translucid.

The invention claimed is:

1. Swimming goggles (1) comprising:

two eyepieces (2), with a substantially cup shape;

a bridge element (6) connecting said two eyepieces (2) at a user's nose; and a strap (7) to wrap the user's head, couple outer ends of each eyepiece (2), and keep the swimming goggles (1) in place when in use, wherein each eyepiece (2) comprises at least one polygonal plan shaped flat front lens or transparent wall (201), and a transparent shell wall (202) composed of a set of polygonal plan shaped transparent walls or flat lenses, wherein the set of transparent walls or flat lenses are joined to each other, along adjacent contact edges, and to a peripheral edge of the at least one flat front lens or transparent wall (201), delimiting a chamber that at a rear part of the eyepiece (2) is completely open towards the user's eye, and wherein the at least one polygonal plan shaped flat front lens or transparent wall has one of the following two inclinations:

inclined forward, causing a lower end of the at least one polygonal plan shaped flat front lens or transparent wall to be forwardly disposed in a front direction with respect to an upper end of the polygonal plan shaped flat front lens or transparent wall, or in an alternative, inclined forward, such to displace the upper end of the at least one transparent wall or front lens forward with respect to the lower end of the at least one transparent wall or front lens.

2. The swimming goggles according to claim 1, wherein a shape of the eyepieces is substantially symmetrical with respect to a transverse plane containing an interpupillary axis, whereby a user is enabled to pass from a configuration of the polygonal plan shaped flat front lens or transparent wall with forward inclination of a lower side with respect to an upper side or to a configuration with an upper side forward with respect to a lower side by mounting the goggles rotated by 180° with respect to an axis coinciding with a sagittal axis in worn condition.

3. The swimming goggles according to claim 1, wherein the transparent shell wall of each eyepiece comprises:

at least one flat upper lens or transparent wall with a polygonal plan shape, allowing upward vision, at least one flat lower lens or transparent wall with a polygonal plan shape, allowing downward vision, at least one inner flat lateral lens or transparent wall with a polygonal plan shape, allowing inward lateral vision, and at least one outer flat lateral lens or transparent wall with a polygonal plan shape, allowing outward lateral.

4. The swimming goggles (1) according to claim 3, wherein an upper portion and a lower portion of said transparent shell wall are inclined towards an inner angle of the eye to promote vision in a lateral-upward and lateral-downward direction.

5. Swimming goggles (1) comprising:

two eyepieces (2), with a substantially cup shape;

a bridge element (6) connecting said two eyepieces (2) at a user's nose; and a strap (7) to wrap the user's head, couple outer ends of each eyepiece (2), and keep the swimming goggles (1) in place when in use, wherein each eyepiece (2) comprises at least one polygonal plan shaped flat front lens or transparent wall (201), and a transparent shell wall (202) composed of a set of polygonal plan shaped transparent walls or flat lenses, wherein the set of transparent walls or flat lenses are joined to each other, along adjacent contact edges, and to a peripheral edge of the at least one flat front lens or transparent wall (201), delimiting a chamber that at a rear part of the eyepiece (2) is completely open towards the user's eye, and wherein said transparent shell wall is in substantially diverging position causing each eyepiece to have a truncated pyramidal shape with an irregular polygonal base.

6. The swimming goggles according to claim 5, wherein on a side of the eyepieces facing the user's eye region, edges of said transparent shell wall are shaped correspondingly to a curved section plane of said pyramidal shape, are curved to be anatomically fitted on or corresponding to a shape of a region of contact of the eyepiece with a face region surrounding a corresponding eye.

7. The swimming goggles (1) according to claim 1, wherein the at least one polygonal plan shaped front lens or transparent wall includes the transparent shell wall (202) joined inclined thereto to form, with an inner surface of said polygonal plan shaped front lens or transparent wall (201), an angle greater than 90°, or comprises at least one lens consisting of the transparent shell wall (202), joined inclined to said polygonal plan shaped flat front lens or transparent wall (201) forming, with an inner surface of said polygonal plan shaped front lens or transparent wall (201), an angle smaller than 90°.

8. The swimming goggles (1) according to claim 1, wherein a lower portion of said transparent side wall (202*b*) is larger than an upper portion of said transparent side wall (202*a*).

9. The swimming goggles (1) according to claim 1, wherein the at least one polygonal plan shaped flat front lens or transparent wall (201) has at least five vertices with two pairs of side edges and a lower and upper edge, two of said vertices being substantially coincident with an outer angle and an inner angle of the user's eye, and wherein the transparent shell wall (202) of each eyepiece (2) comprises two pairs of polygonal plan shaped flat lenses (202*c*, 202*f* and 202*e*, 202*d*) joined with a peripheral edge of said polygonal plan shaped flat front lens or transparent wall (201) and further joined with each other, along adjacent contact edges, such to form a V shape, in section, with a vertex at an outer angle and inner angle of the user's eye respectively.

10. The swimming goggles (1) according to claim 9, wherein the at least one polygonal plan shaped flat front lens (202*c*, 202*f*) or transparent shell wall (202) has a first vertex at the outer angle of the eye and a second vertex at the inner angle of the eye, and wherein the first vertex is defined by a first angle larger than a second angle defining the second vertex.

11. The swimming goggles (1) according to claim 1, wherein the set of transparent walls or flat lenses and the at least one flat front lens or transparent wall divide the visual field into a plurality of visual sub-fields with a predetermined angle of view, said visual sub-fields corresponding to:

a forward visual field portion (a);
an upper visual field portion (b);
an upward outer lateral visual field portion (c);
a downward outer lateral visual field portion (d);
a lower visual field portion (e);
a upward inner lateral visual field portion (f); and
a downward inner lateral visual field portion (g), and
wherein each of the transparent walls or flat lenses and the at least one flat front lens or transparent wall is disposed to be perpendicular to a central visual axis of the visual sub-field corresponding thereto with the goggles (1) in a worn condition.

12. The swimming goggles (1) according to claim 11, wherein an area of the transparent walls or flat lenses and the at least one flat front lens or transparent wall corresponding to:

the forward visual field portion (a);
the upward outer lateral visual field portion (c);
the downward outer lateral visual field portion (d); and
the lower visual field portion (e),
is greater than the area of the lenses (202*a*, 202*e*, 202*d*) provided for vision in remaining portions of the visual field which includes the upper visual field portion (b), the upward inner lateral visual field portion (f), and the downward inner lateral visual field portion (g).

13. The swimming goggles (1) according to claim 1, wherein a number of sides of the polygonal plan shaped flat front lens or wall (201) and a number of polygonal plan shaped flat lenses of the shell wall (202) is kept reduced to maximize a surface of the lenses and a continuity of an overall visual field and to minimize a number of connections between the lenses and distortions of the overall visual field.

14. The swimming goggles (1) according to claim 1, wherein the polygonal plan shaped flat front lens or wall (201) is inclined forward such to forwardly displace in a front direction a lower end of the polygonal plan shaped flat front lens or wall with respect to an upper end of the polygonal plan shaped flat front lens or wall.

15. The swimming goggles (1) according to claim 1, wherein, with reference to the goggles worn by the user in an upright position, the at least one polygonal plan shaped flat front lens or transparent wall (201) has a forward inclination of a lower end with respect to an upper end, corresponding to an angle Z ranging from 10 to 21°.

16. The swimming goggles (1) according to claim 1, wherein the at least one polygonal plan shaped flat front lens or transparent wall (201) is inclined forward and it has dimensions that generate a forward visual field with an angle size Y ranging from 70° to 80°.

17. The swimming goggles (1) according to claim 11, wherein the lens (202*b*) corresponding to the lower visual field portion (e) is inclined with respect to the polygonal plan shaped flat front lens or wall (201) and it has such dimensions to generate a visual field adjacent to the upper visual field having an angle size X ranging from from 30° to 35°.

18. The swimming goggles (1) according to claim 11, wherein an angle size of the forward visual field of the user wearing the goggles (1) is comparable to the angle size of the forward visual field of the user with no goggles (1), said field extending in a continuous manner, with minimal distortions due to connections between the lenses, from the user's eyebrow arch to the user's cheeks.

19. The swimming goggles (1) according to claim 1, wherein each eyepiece (2) is provided with coupling seats (4, 5) of the bridge element (6) and the strap (7), said seats being provided on a plane parallel to a transverse axis of the user's skull.

20. The swimming goggles (1) according to claim 1, further comprising a peripheral adhesion lip (3) radially extending from a peripheral edge of the shell wall (202), shaped to allow each eyepiece (2) to rest on the user's face at the eyes.

21. The swimming goggles (1) according to claim 20, wherein the peripheral adhesion lip (3) or the peripheral edge of the shell wall (202) is provided with a soft watertight element adapted to contact the user's face and to accomplish watertightness between the user's face and each eyepiece (2).

22. The swimming goggles according to claim 1, wherein the at least one polygonal plan shaped flat front lens or transparent wall is composed of a polygon selected from the group consisting of: pentagon, hexagon, heptagon, and octagon, the transparent shell wall having a corresponding number of flat transparent walls or flat lenses.

* * * * *